US005348148A

United States Patent [19]

Lancaster

[11] Patent Number: 5,348,148

[45] Date of Patent: Sep. 20, 1994

[54] CONTAINER FOR A HANGER-SUPPORTED GARMENT

[75] Inventor: Gary D. Lancaster, Lewisburg, Tenn.

[73] Assignee: The Mead Corporation, Dayton, Ohio

[21] Appl. No.: 941,030

[22] Filed: Sep. 4, 1992

[51] Int. Cl.[5] ..... B65D 5/08; B65D 85/18

[52] U.S. Cl. ..... 206/288; 206/279; 206/289; 206/299; 229/109

[58] Field of Search ..... 206/278, 279, 280, 288, 206/289, 292, 299; 229/109, 110

[56] References Cited

U.S. PATENT DOCUMENTS

| | | | |
|---|---|---|---|
| 1,626,381 | 4/1927 | Batts | 206/279 |
| 2,310,499 | 2/1943 | Vineberg | 206/288 |
| 2,331,754 | 10/1943 | Wohlers | 229/39 |
| 2,883,042 | 4/1959 | Richer | 206/279 |
| 3,286,910 | 11/1966 | Offenburger | 229/117.19 X |
| 3,512,697 | 5/1970 | Robinson | 229/109 |
| 3,797,731 | 3/1974 | Weldon | 229/117.16 |
| 3,999,657 | 12/1976 | Doskocil | 206/289 |
| 4,085,842 | 4/1978 | Beck | 206/289 |
| 4,131,229 | 12/1978 | Nastasi | 229/39 |
| 4,318,472 | 3/1982 | Nauheimer et al. | 206/284 |
| 4,678,079 | 7/1987 | Henning | 206/279 |
| 4,693,367 | 9/1987 | Mathieu | 206/279 X |
| 4,793,546 | 12/1988 | Nunn | 229/109 |
| 4,944,395 | 7/1990 | Coursen | 206/279 X |
| 5,058,740 | 10/1991 | Coursen | 206/299 X |

*Primary Examiner*—Sue A. Weaver
*Attorney, Agent, or Firm*—Tsugihiko Suzuki

[57] ABSTRACT

A container comprises front and rear opposed walls, a pair of opposed side walls, a pair of beveled shoulder walls, and a hanger support panel. The front and rear walls are interconnected by the side walls along generally parallel fold lines to form an upright tubular enclosure. The beveled shoulder walls are arranged adjacent to the tops of the side walls and extend between the front and rear walls. Each shoulder wall is disposed at an obtuse angle with respect to the adjacent side wall. The distance between the upper edges of the shoulder walls is less than the distance between the lower edges of the shoulder walls. The hanger support panel is foldably joined to the top edge of the rear wall. The support panel rests on and bridges between the upper edges of the shoulder walls. The support panel is provided with hanger-engaging slot so that a hanger-supported article to be placed in the tubular enclosure can hang from the support panel.

12 Claims, 7 Drawing Sheets

CONTAINER FOR A HANGER-SUPPORTED GARMENT

BACKGROUND OF THE INVENTION

This invention relates to a container of the type utilized to transport an article(s) supported by a hanger, and more particularly to a corrugated paperboard container suitable for shipping an airline passenger's garment bag, which has an improved top panel arrangement for supporting a hanger.

Paperboard containers are commonly used for shipping hanger-supported articles such as hanger-supported garments and airline passengers' garment bags. One such container is shown in U.S. Pat. No. 2,883,042. The disclosed container employs a plurality of top panels to hang hanger-supported articles therefrom. The top panels are superposed one on another to ensure the structural strength of the top portion of the container. The top panels except for the uppermost one have slots and apertures for engaging the hooks of hangers. The uppermost panel is glued to the lower adjacent panel to function as a hanger retainer for preventing the hangers from disengaging from the slots and apertures.

Another conventional garment container is disclosed in U.S. Pat. No. 4,944,395. The container of this patent includes a hanger bar structure joined at one end thereof to the front wall of the container and engaged at the other end thereof with the rear wall of the container. A retainer panel is foldably joined to the rear wall and is disposed over the hanger bar structure to secure hangers placed on the structure in position. This retainer panel is held in the securing position by an integral portion thereof forced by the paperboard resiliency to be disposed under the adjacent portion of the container. It is likely in the container of this patent that the retainer panel may be accidentally displaced from the securing position in which it prevents hangers from coming off of the hanger bar structure.

What is needed, therefore, is a container for a hanger-supported article. Such a container should have a sturdy hanger support means which requires less material. Such a container should also have a hanger retainer means which can be reliably locked in a securing position without using glue or any other adhesives.

SUMMARY OF THE INVENTION

According to this invention in one aspect, a container is provided with a hanger support panel which is supported at two spaced supporting points by a pair of beveled shoulder walls. The two supporting points are disposed at a distance less than the distance between a pair of side walls of the container. This arrangement allows less bending moment exerted on the support panel than an arrangement in which such a panel is supported directly by the side walls of a container.

One manifestation of the invention resides in a container which comprises front and rear opposed walls, a pair of opposed side walls, a pair of beveled shoulder walls, and a hanger support panel. The front and rear walls are interconnected by the side walls along generally parallel fold lines to form an upright tubular enclosure. The beveled shoulder walls are arranged adjacent to the tops of the side walls and extend between the front and rear walls. Each shoulder wall is disposed at an obtuse angle with respect to the adjacent side wall. The distance between the upper edges of the shoulder walls is less than the distance between the lower edges of the shoulder walls. The hanger support panel is foldably joined to the top edge of the rear wall. This panel rests on and bridges between the upper edges of the shoulder walls. The support panel is provided with hanger-engaging means so that a hanger-supported article to be placed in the tubular enclosure can hang from the support panel.

According to another aspect of the present invention, a container incorporates so called "double tuck lock closure tabs" to lock a hanger retainer panel in position in order to get around gluing of the retainer panel and to avoid accidental hanger disengagement from a hanger support panel.

One manifestation of the invention resides in a container which comprises front and rear opposed walls, a pair of opposed side walls, a hanger support panel with hanger-engaging means, and a retainer panel. The front and rear panels are interconnected by the side walls along generally parallel fold lines to form an upright tubular enclosure. The hanger support panel having hanger-engaging means is foldably joined to the top edge of the rear wall and bridges between the front and rear walls. The support panel has a locking slot formed therethrough. The locking slot extends along the top edge of the rear wall. The retainer panel is foldably joined to the top edge of the front wall and overlies the support panel. A locking tab is foldably joined to the free edge of the retainer panel and has a keeper slot formed therethrough. The keeper slot extends along the free edge of the retainer panel. The locking tab is releasably inserted into the locking slot. A keeper is struck from both the rear wall and the support panel. The keeper includes a body portion and a tongue. The body portion is struck from and foldably joined at the base thereof to the rear wall. The tongue is struck from the support panel and is foldably joined to the body portion. The tongue is releasably inserted into the keeper slot.

Accordingly, it is an object of the present invention to provide a container for a hanger-supported article having an improved hanger support panel arrangement of a good structural strength which can tolerate the load of the hanger-supported article; to provide such a container having a hanger support panel which require minimum paperboard; to provide such a container with a hanger retainer panel which is locked in position by a mechanical lock; and to provide such a container having hanger support panel suitable for incorporating a mechanical lock.

Other objects and advantages of the present invention will be apparent from the following description, accompanying drawings and the appended claims.

DETAILED DESCRIPTION OF THE PREFERRED EMBODIMENT

Figure 1:
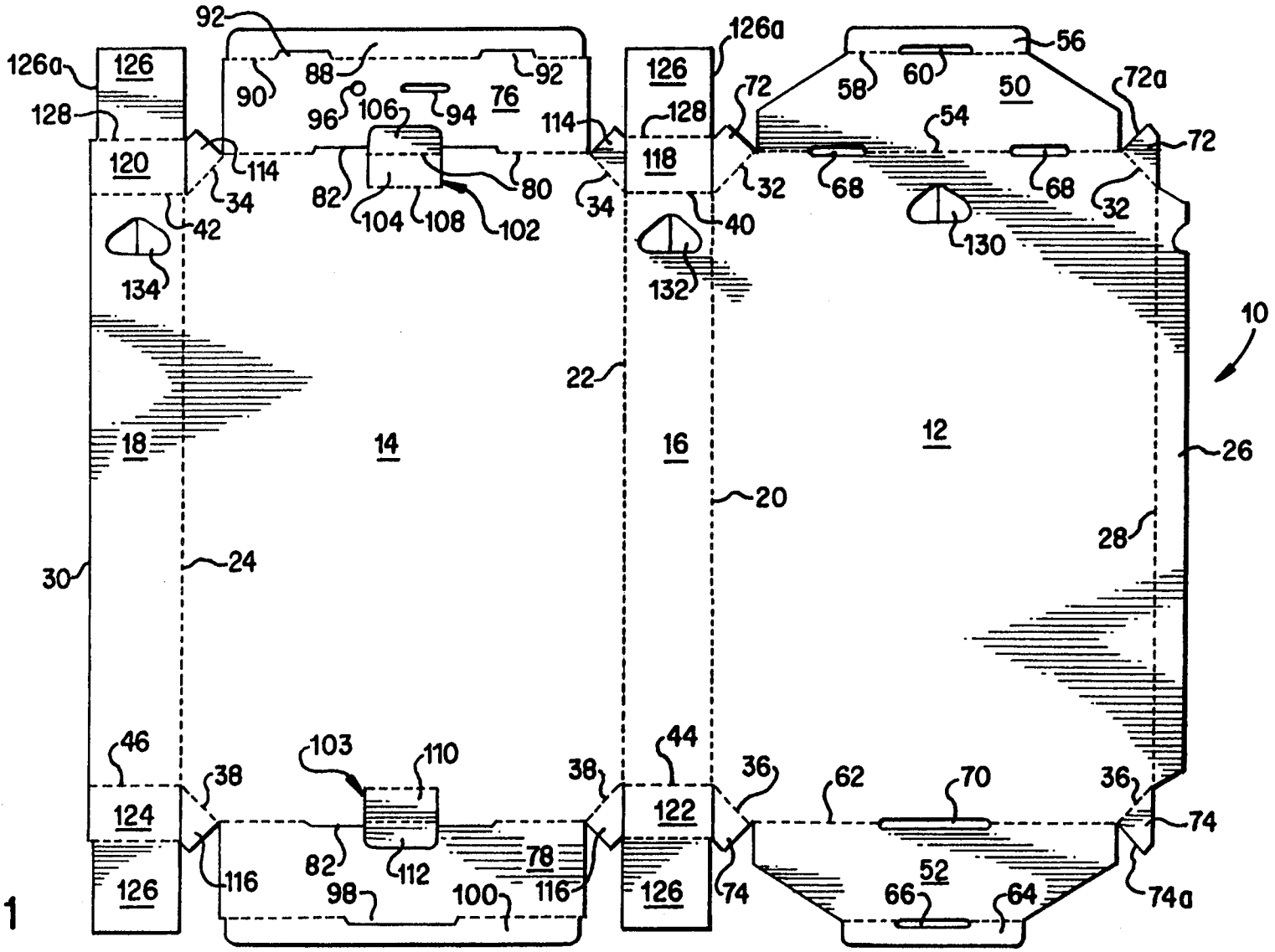
FIG. 1 is a plan view of a blank from which a container according to the present invention is formed.

Referring now to the drawings, a container according to the present invention is illustrated in blank form in FIG. 1. The blank 10 is designed to form a garment container, such as for an airline passenger's garment bag, and is formed preferably from a cut and scored corrugated paperboard.

The blank 10 includes a front wall 12, a rear wall 14, and a pair of side walls 16 and 18. The side wall 16 is foldably joined to the front wall 12 along a fold line 20. The rear wall 14 is foldably joined to the side wall 16 along a fold line 22 opposite the fold line 20. The side wall 18 is foldably joined to the rear wall 14 along a fold line 24 opposite the fold line 22. In addition, a glue flap 26 is foldably joined to the front wall 12 along a fold line 28 opposite the fold line 20. This glue flap 26 is used for connecting the front wall 12 to the free side edge 30 of the side wall 18 to form a substantially tubular enclosure out of the walls 12, 14, 16 and 18.

In the most preferred embodiment, the front and rear walls 12 and 14 are of an octagonal configuration which includes upper and lower tapered portions defined by corner edges 32, 34, 36 and 38. The upper tapered portions of the front and rear walls 12 and 14, as shown in FIG. 1, extend outwardly beyond a hypothetical line aligning with the top edges 40 and 42 of the side walls 16 and 18. Likewise, the lower tapered portions extend outwardly beyond a hypothetical line aligning with the bottom edges 44 and 46 of the side walls 16 and 18. The blank with such octagonal walls 12 and 14 can be assembled into a container having a chamfered or cornerless outline which can facilitate movement of the container itself along airline luggage conveyor system. It is to be appreciated, however, these walls 12 and 14 may be of any configuration, such as a hexagonal configuration, so long as such a configuration is suitable for accommodating a top panel arrangement of the present invention which will be described later in detail.

The front wall 12 is provided at the upper edge thereof with an outer top panel or retainer panel 50 and at the lower edge thereof with an outer bottom panel 52. The retainer panel 50 is foldably joined to the front wall 12 along a fold line 54 extending coincidentally with the upper edge of the front wall 12. A locking tab 56 is foldably joined to the free edge of the retainer panel 50 along a fold line 58. A keeper slot 60 which extends along the fold line 58 is formed in the locking tab 56. In like manner, the outer bottom panel 52 is foldably joined to the front wall 12 along a fold line 62, and it has a foldable locking tab 64 with a keeper slot 66.

The front wall 12 is also provided with two spaced upper engaging slots 68 extending along the fold line 54 and with a lower engaging slot 70 extending along the fold line 62.

The front wall 12 is provided further with corner flaps 72 and 74 foldably joined thereto along fold lines extending coincidentally with the corner edges 32 and 36 respectively. The free edge 72*a* of each upper corner flap 72 that is adjacent to the retainer panel 50 extends generally perpendicularly to the respective fold line 32. In like manner, the free edge 74*a* of each lower corner flap 74 adjacent to the outer bottom panel 52 extends generally perpendicularly to the respective fold line 36.

Figure 4:
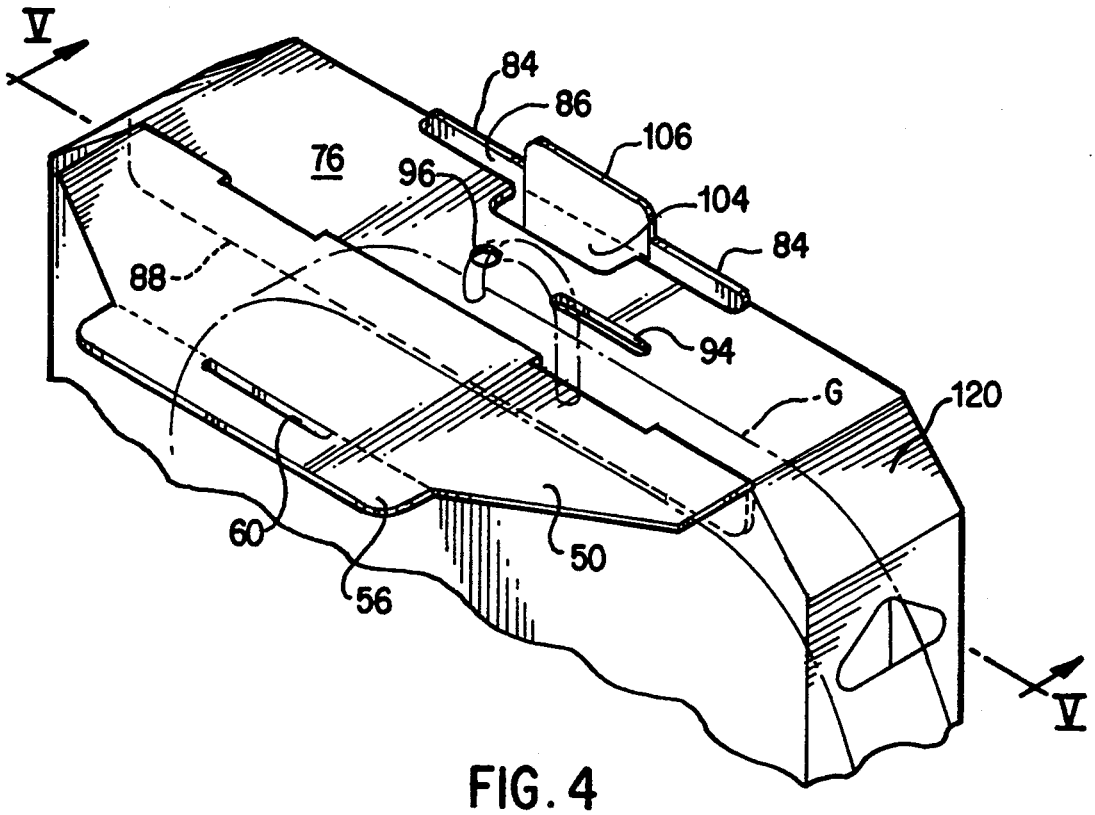
FIG. 4 is an enlarged perspective view of the top portion of the container with a support panel in a horizontal position.

The rear wall 14 is provided at the upper edge thereof with an inner top panel or hanger support panel 76 and at the lower edge thereof with an inner bottom panel 78. The hanger support panel 76 is foldably joined to the rear wall 14 along an interrupted fold line 80 that extends coincidentally with the upper edge of the rear wall 14. An interrupted slit 82 is formed in the support panel 76. This slit 82 extends alongside the fold line 80 and merges at the opposite extremity thereof into the fold line 80. As a result, when the support panel 76 is folded at a right angle about the fold line 80 as shown in FIG. 4, protrusions 84 project from the upper edge of the rear wall 14 and at the same time a locking slot 86 is defined in the support panel 76 by the slit 82. The vertical dimension of such protrusions 84 is generally equal to the thickness of the paperboard from which the blank of the container is cut.

Figure 2:
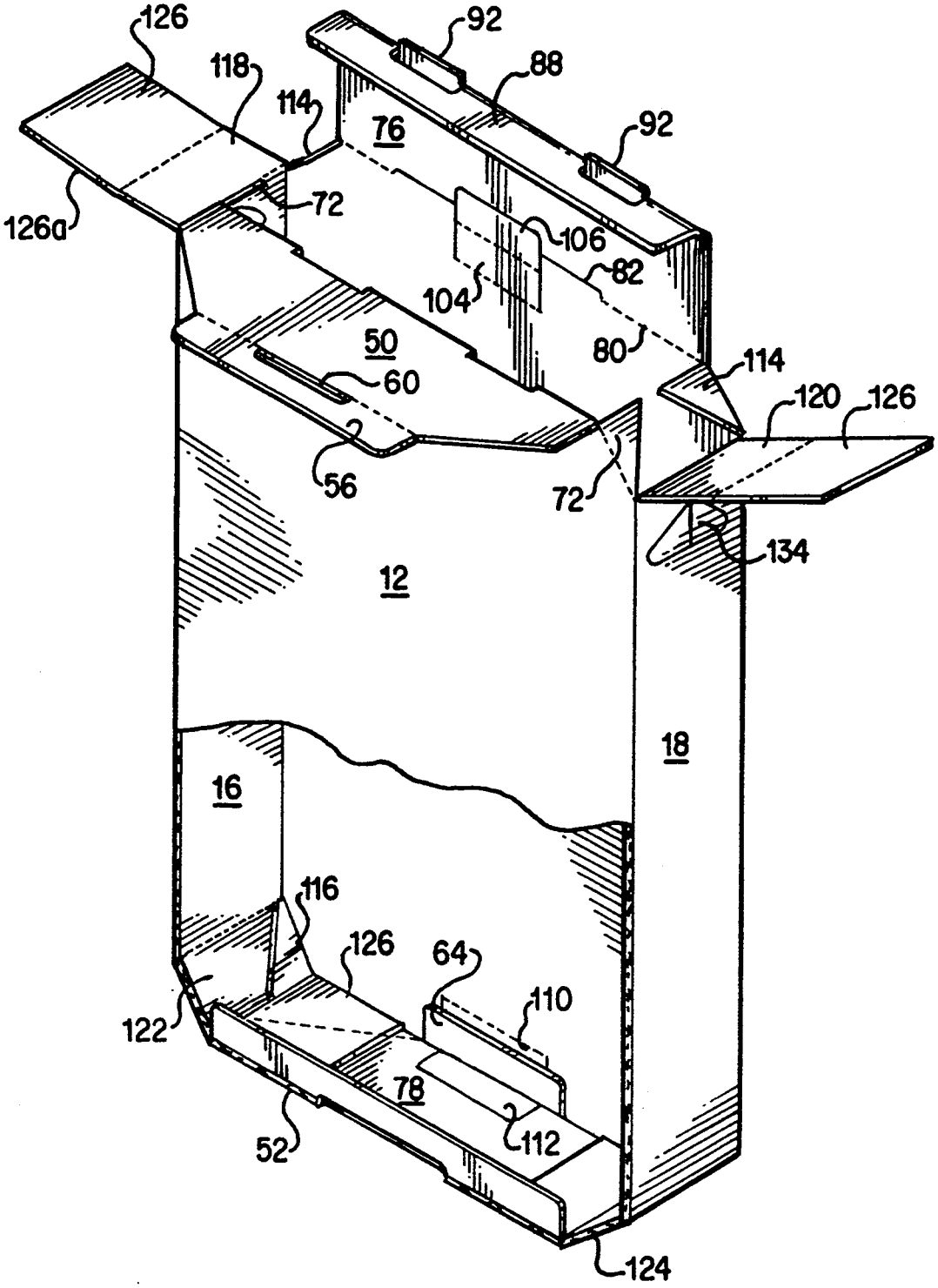
FIG. 2 is a perspective view of the container with the top open and the bottom closed.

A reinforcement flap 88 is foldably joined to the free edge of the support panel 74 along an interrupted fold line 90. Two spaced engaging tabs or projections 92 are struck from the reinforcement flap 88 and joined at the bases thereof to the support panel 74. These tabs 92 project from the free edge of the support panel 76 when the reinforcement flap 88 is folded about the fold line 90 as shown in FIG. 2.

Returning to FIG. 1, a hanger slot 94 and an aperture 96 are formed in the portion of the support panel 76 intermediate the length and the width thereof to serve as a hanger-engaging means. The slot 94 extends generally parallel to the fold line 80. The aperture 96 is spaced from one of the ends of the slot 94 and is aligned with the slot 94. The hook of a hanger is adapted to extend between the slot 94 and the aperture 96 with the tip thereof received in the aperture 96 so that it can rest on and engage with that portion of the support panel 76 between the slot 94 and the aperture 96. Any reinforcement such as a length of tape, plastic sheet, layer of paperboard or any other means for reinforcing the intermediate portion of the support panel 76 may be affixed to the support panel 76.

The inner bottom panel 78 has no hanger-engaging means and has only one engaging projection 98 struck from the respective reinforcement flap 100. The other details of the inner bottom panel 78 is identical to the support panel 76. Therefore the like portions of the inner bottom panel 78 are designated by the same reference numerals and the description thereof is omitted.

The rear wall 14 is further provided with upper and lower keepers 102 and 103. The upper keeper 102 includes a body portion 104 and a tongue 106. The body portion 104 is struck from the upper portion of the rear wall 14 and is foldably joined at the base thereof to the rear wall 14 along a fold line 108. The tongue 106 is struck from the support panel 76 and is foldably joined to the body portion 104 along the fold line 80. Likewise, the lower keeper 103 includes a body portion 110 which is struck from the lower portion of the rear wall 14 and a tongue 112 which is struck from the inner bottom panel 78. The other details of the lower keeper 103 is similar to the upper keeper 102, and therefore the description thereof is omitted.

In similar manner to the front wall 12, the rear wall 14 is also provided with upper and lower corner flaps 114 and 116. The details of these corner flaps 114 and 116 are similar to the corner flaps 72 and 74 of the front wall, and therefore the description thereof is omitted.

As further illustrated in FIG. 1, the side panels 16 and 18 are provided with shoulder walls 118 and 120 and with foot walls 122 and 124, each accompanied by an anchor flap 126. The shoulder walls 118 and 120 are foldably joined respectively to the top edges 40 and 42 of the side walls 16 and 18. The foot walls 122 and 124 are foldably joined respectively to the bottom edges 44 and 46 of the side walls 16 and 18. Since these shoulder and foot walls are the same in structure, only the shoulder wall 118 will hereinafter be described.

The shoulder wall 118 is generally rectangular in shape. The width of the shoulder wall 118 along the fold line 40 is generally equal to the width of the side wall 16. The distance between the fold line 40 and the upper edge 128 of the shoulder wall 118 is generally equal to the length of the adjacent upper corner edge 32 of the front wall 12. The anchor flap 126 is foldably joined to the upper edge of the shoulder wall 118. One of the opposite side edges of the anchor flap 126 is aligned with the adjacent side edge of the shoulder wall 118 whereas the other side edge 126*a* of the anchor flap 126 is set back entirely therealong from the adjacent side edge of the shoulder wall 118. This arrangement allows the shoulder wall 118 to rest on and extend between the front and rear walls 12 and 14 when the container is assembled.

In addition, access holes or hand holes 130, 132 and 134 may be formed in suitable portions of the container such as in the respective upper portions of the front and side walls 12, 16 and 18. Access holes of any shape and size may be employed by the container of the present invention. In the preferred embodiment, however, each access hole has an inverted V-shaped upper edge and foldable closure flaps for forming hand cushions. Such access holes are disclosed in U.S. Pat. No. 3,797,731 which is hereby incorporated in the description by reference.

The blank 10 described above is preassembled into a flat collapsed tubular form by securing the glue flap 26 to the inside surface of the side wall 18, and then is delivered to the airline where the container is fully assembled to ship a passenger's garment bag. To assemble the collapsed tubular container, the container is first formed into a three-dimensional upright tubular structure wherein the front and rear walls 12 and 14 are disposed parallel to each other with the side walls 16 and 18 extending therebetween. Then, the bottom of the container is set up as best shown in FIG. 2. Since set up of the bottom of the container is similar to set up of the top thereof, only the assembling process for the top of the container will be herein after described.

Figure 3:
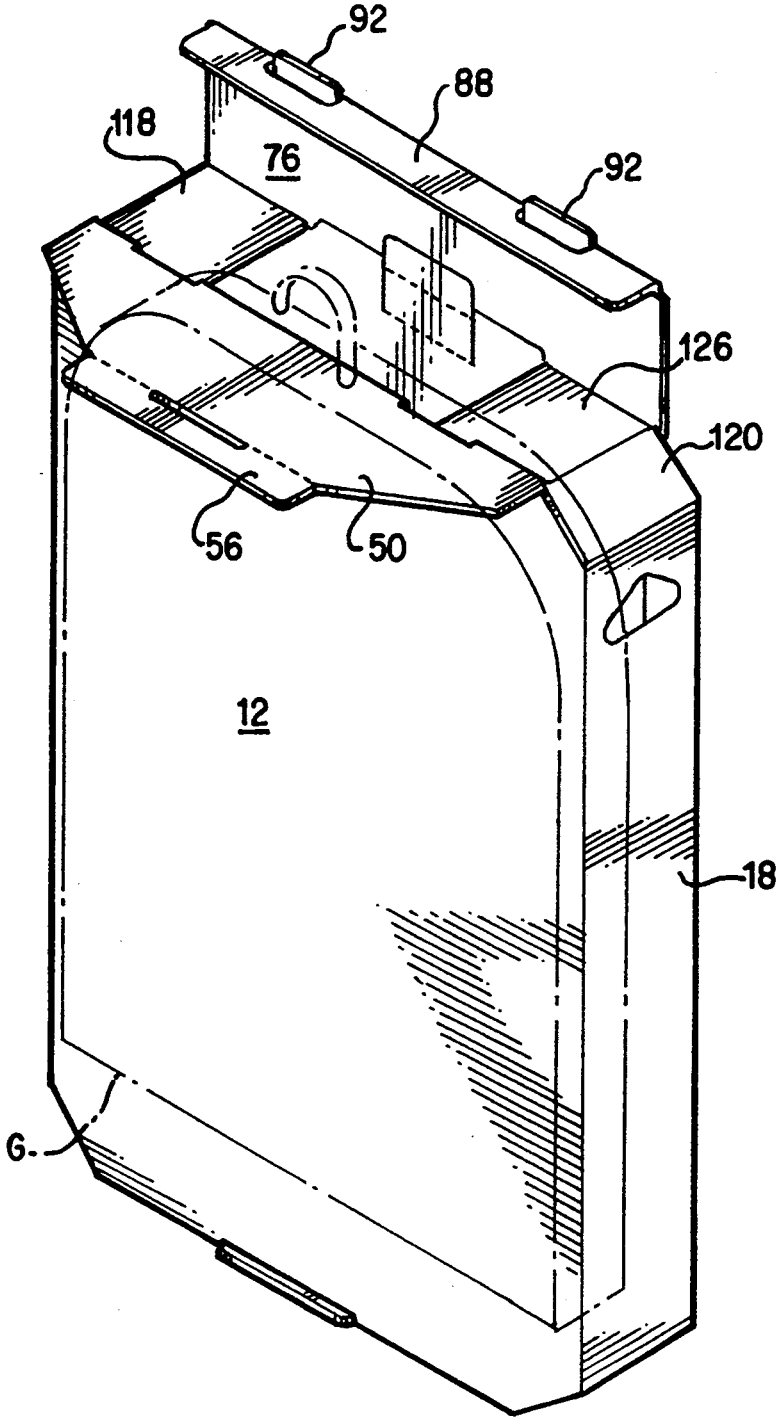
FIG. 3 is a perspective view similar to FIG. 2, showing shoulder walls folded inwardly of the container.
Figure 5:
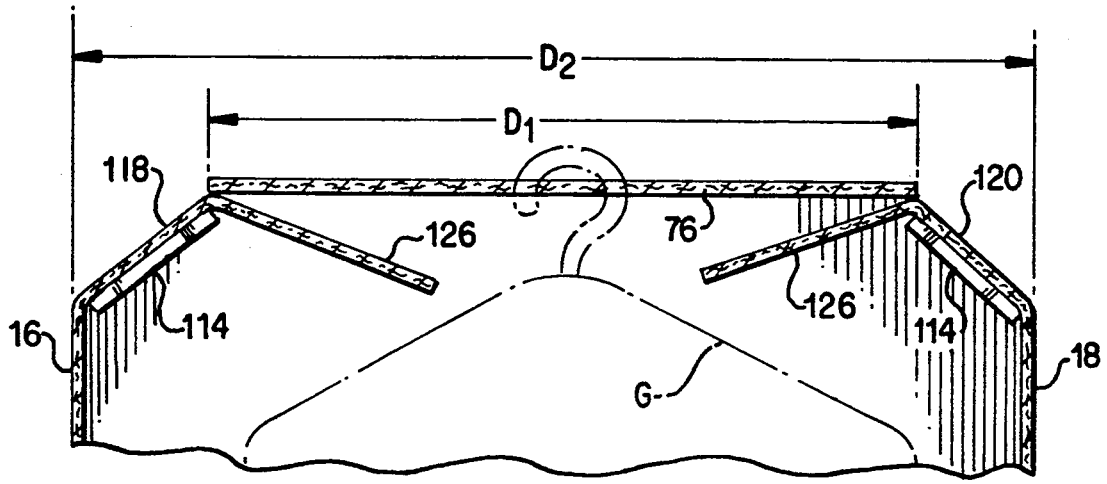
FIG. 5 is a view taken along the line V—V in FIG. 4.

With the top open and the bottom closed as shown in FIG. 2, the container is packed with an hanger-supported article such as a garment bag G (see FIG. 3). The garment bag G is introduced into the container through the open top. The upper corner flaps 72 and 114 are folded inwardly of the container to positions where they are disposed generally perpendicularly to the front and rear walls 12 and 14. The shoulder walls 118 and 120 are then folded inwardly of the container over the adjacent ones of the corner flaps 72 and 114 as shown in FIG. 3. When in the position over the corner flaps, the shoulder walls 118 and 120 are supported by the corner flaps at respective positions where they are disposed at an obtuse angle with respect to the side walls 16 and 18 as best shown in FIG. 5.

After the foregoing steps, the reinforcing flap 88 is folded at a right angle with respect to the support panel 76, and then the support panel 76 is lowered to a horizontal position as shown in FIG. 4. During the lowering step, the hook of the garment bag G is inserted into the hanger slot 94 from below, and the tip of the hook is inserted into the aperture 96 from above. The projections 92 at the free edge of the support panel 76 is inserted into the complementary engaging slots 68, and thereby the support panel 74 is locked in the horizontal position. When in the horizontal position, the support panel 76 rests on and bridges between the upper edges of the beveled shoulder walls 118 and 120 as best shown in FIG. 5. In this arrangement, bending moment exerted on the support panel due to the load of the garment bag G is substantially less than the bending moment which would be exerted on a conventional support panel directly supported by the side walls. This is because the distance ($D_1$) between the upper edges of the shoulder walls 118 and 120 are much less than the distance ($D_2$) between the top edges of the side walls 16 and 18.

Figure 6:
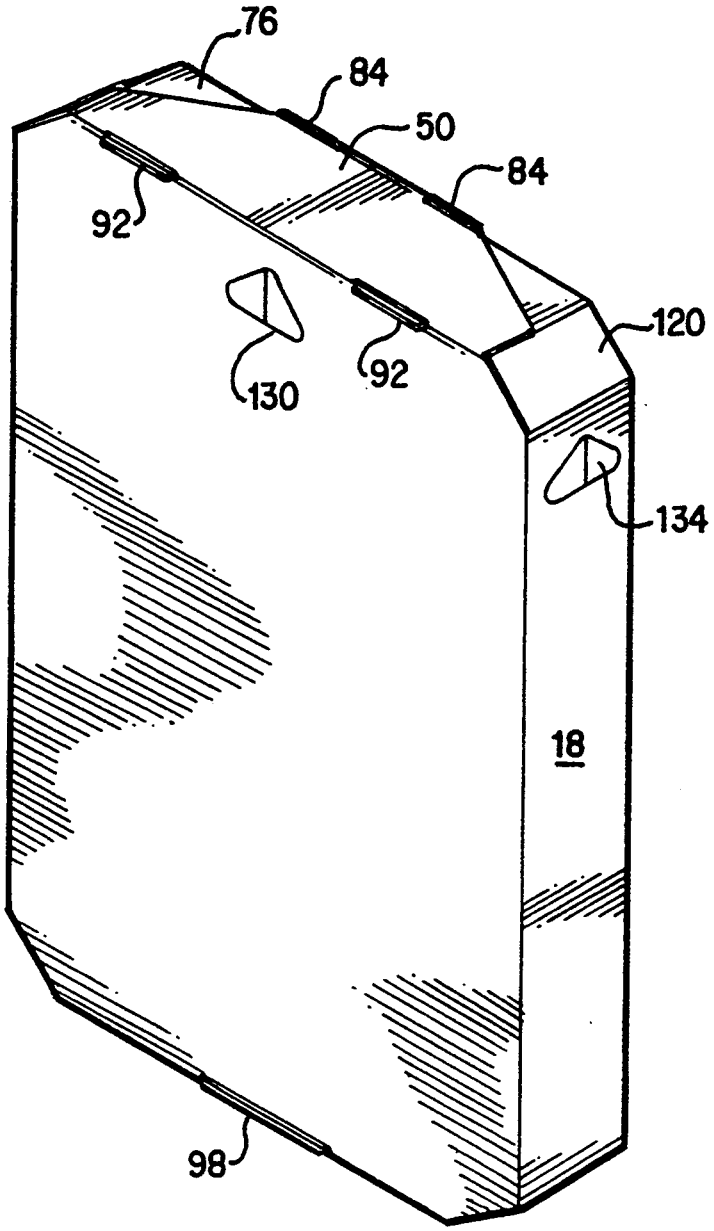
FIG. 6 is a perspective view of the container in a fully assembled condition.

After locking the support panel 74 in the horizontal position, the locking tab 56 is folded at a right angle with respect to the retainer panel 50, and the retainer panel 50 is folded inwardly of the container to a position over the support panel 76 (see FIG. 6). During this folding step of the panel 50, the locking tab 56 is inserted into the locking slot 84 (see FIG. 4). When overlying the support panel 76, the retainer panel 50 presses the hook of the garment bag G against the support panel and thereby prevents the hook from disengaging from the hanger-engaging means 94 and 96.

Finally, the keeper 102 is pivoted outwardly of the container about the fold line 108, the tongue 106 is folded inwardly of the container about the fold line 80, and the tongue 106 is inserted into the keeper slot 60 of the locking tab 56. Due to this tongue insertion, the locking tab 56 is locked in the locking slot 86. Therefore, the retainer panel 50 is prevented from accidentally displaced from the horizontal position where it secures the hook of the garment bag. Fully assembled container is illustrated in FIG. 6.

Figure 7:
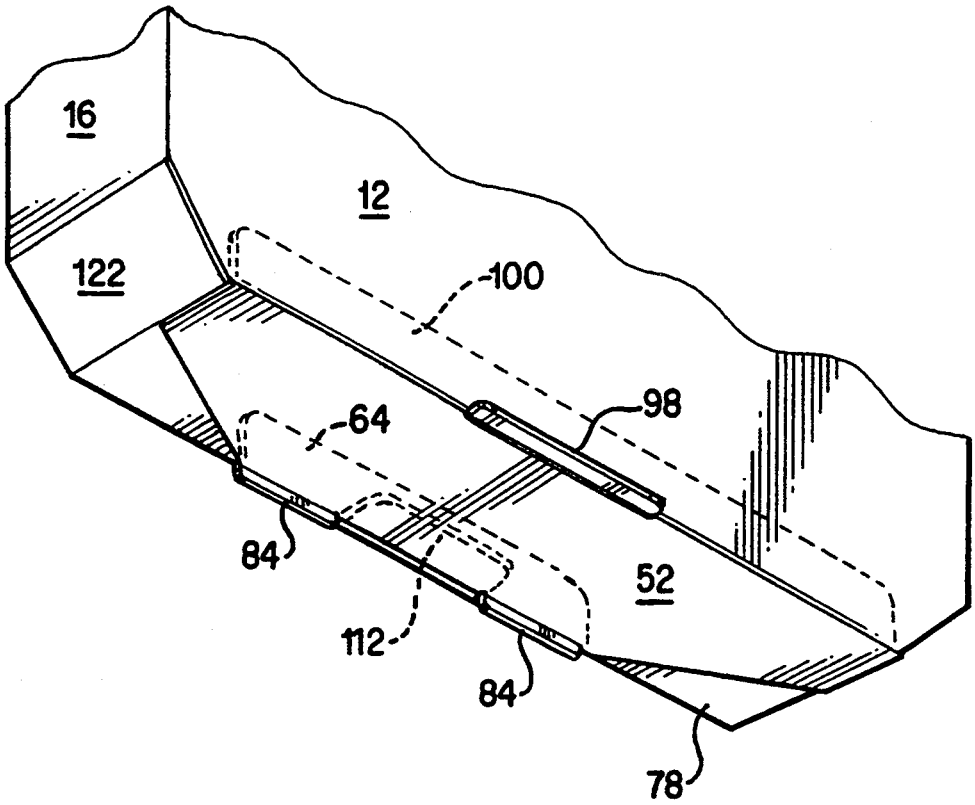
FIG. 7 is an enlarged perspective view of the bottom portion of the container.

In addition, the bottom of the assembled container is shown in FIG. 7. As shown in this drawing, the lower ends of the protrusions 84 projecting downwardly from the rear wall 14 are disposed in the plane of outside surface the outer bottom panel 52. These protrusions 84 bear the load of the container in cooperation with the outer bottom panel 52 when the container is placed on a floor. Stated differently, the outer bottom panel 52 is prevented from bearing the load all alone, and is thereby prevented from sinking into the inner bottom panel 74.

Figure 8:
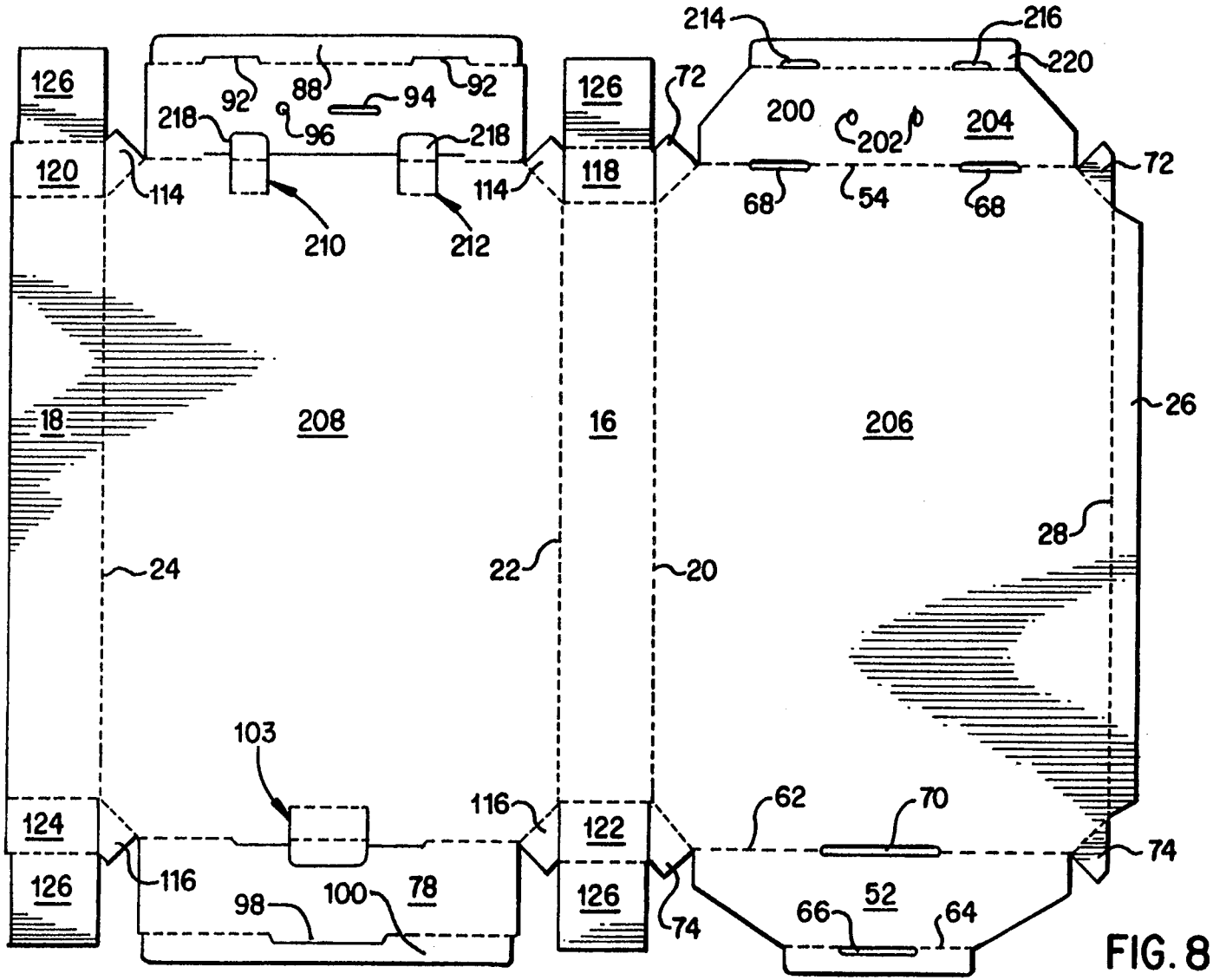
FIG. 8 is a plan view of a blank of a modified form of the container in FIG. 1.

FIG. 8 illustrates a blank for a modified form of the container shown in FIG. 1. This container is designed to be carried by a separate handle. For this reason no access hole is formed in the container walls.

As shown in FIG. 8, two spaced handle apertures 200 and 202 are provided in the retainer panel 204. These apertures 200 and 202 are arranged in a line parallel to the fold line 54 between the retainer panel 204 and the front wall 206. A plastic handle (not shown) is mounted on the retainer panel 204 by twisting and inserting the ends thereof through the handle apertures 200 and 202. Such ends may be T-shaped and therefore will return to their normal configuration after being inserted through the apertures 200 and 202 so that they engage the peripheral portions of the apertures, respectively. A plastic handle which may be used in this invention is disclosed, for example, in U.S. Pat. No. 3,286,910 which is hereby incorporated in the description. However, any handle made of a material having good tensile strength and some resiliency may be used in this invention.

As further illustrated in FIG. 8, the container has two upper keepers 210 and 212 to provide sufficient strength in the connection between the retainer panel 204 and the rear wall 208 to support the weight of the filled container. A pair of keeper slots 214 and 216 for releasably receiving the tongues 218 of the keepers 210 and 212 are formed in the locking tab 220. The other details of this container are identical to the container shown in FIG. 1. Therefore, the like parts are denoted by the same reference numerals and the description thereof is omitted.

Having described the invention in detail and by reference to the preferred embodiment thereof, it will be apparent that modification and variation are possible without departing from the scope of the invention defined in the appended claims.

What is claimed is:

1. A container for a hanger-supported article, comprising:

front and rear opposed walls interconnected by a pair of opposed side walls along generally parallel fold lines to form an upright tubular enclosure;

a pair of beveled shoulder walls joined to said tubular enclosure, said shoulder walls being arranged adjacent to tops of said side walls and being dimensioned such that said shoulder walls extend between said front and rear walls, each of said beveled shoulder walls having upper and lower edges and being disposed at an obtuse angle with respect to the adjacent one of said side walls, the distance between said upper edges of said shoulder walls being less than the distance between said lower edges of said shoulder walls; and a hanger support panel including means for foldably joining said support panel to a top edge of said rear wall, said support panel when folded being disposed at a generally right angle with respect to said front and rear walls, said support panel being dimensioned such that said support panel extends between and is supported at two spaced portions thereof by said upper edges of said shoulder walls, said support panel having hanger-engaging means for engagement with a hanger, whereby a hanger-supported article placed in said tubular enclosure can hang from said hanger support panel, wherein each of said front and rear walls has a tapered upper portion defined by a pair of upper corner edges, a corner flap is provided for each of said corner edges of said front and rear walls, said corner flap including means for foldably joining said corner flap to said each corner edge, said corner flap when folded being disposed generally perpendicularly to said front and rear walls, and each of said shoulder walls includes means for foldably joining said lower edge of said each shoulder wall to the adjacent one of said tops of said side walls, said each shoulder wall being dimensioned such that said each shoulder wall is disposed over the adjacent ones of said corner flaps to thereby be supported in a position where the respective shoulder wall extends between said front and rear walls.

2. A container according to claim 1, wherein an anchor flap is provided for said each shoulder wall, said anchor flap including means for foldably joining said anchor flap to said upper edge of said each shoulder wall, said anchor flap being disposed under said support panel to retain the adjacent one of said shoulder walls in position, said anchor flap being dimensioned such that said anchor flap extends between said front and rear walls to serve as a spacer therebetween, said anchor flap having opposite side edges extending between a free end thereof and the adjacent one of said shoulder walls, at least one of said opposite side edges being set back substantially from a side edge of the adjacent one of said shoulder walls so that each of said shoulder walls is greater in width than the adjacent one of said anchor flaps, whereby said shoulder walls rest on and bridge between said front and rear walls.

3. A container according to claim 1, further comprising bottom closure panels including means for foldably joining said closure panels to said front and rear walls.

4. A container for a hanger-supported article, comprising:

front and rear opposed walls interconnected by a pair of opposed side walls along generally parallel fold lines to form an upright tubular enclosure;

a pair of beveled shoulder walls joined to said tubular enclosure, said shoulder walls being arranged adjacent to tops of said side walls and being dimensioned such that said shoulder walls extend between said front and rear walls, each of said beveled shoulder walls having upper and lower edges and being disposed at an obtuse angle with respect to the adjacent one of said side walls, the distance between said upper edges of said shoulder walls being less than the distance between said lower edges of said shoulder walls;

a hanger support panel including means for foldably joining said support panel to a top edge of said rear wall, said support panel when folded being disposed at a generally right angle with respect to said front and rear walls, said support panel being dimensioned such that said support panel extends between and is supported at two spaced portions thereof by said upper edges of said shoulder walls, said support panel having hanger-engaging means for engagement with a hanger, whereby a hanger-supported article placed in said tubular enclosure can hang from said hanger support panel;

a retainer panel including means for foldably joining said retainer panel to a top edge of said front wall, said retainer panel being positioned to overlie said support panel so as to hold a hanger engaged with said hanger-engaging means; and a locking tab including means for foldably joining said locking tab to a free edge of said retainer panel, said support panel having a locking slot formed therein, said locking slot being dimensioned for receiving said locking tab.

5. A container according to claim 4, further comprising a keeper positioned for locking said locking tab in said locking slot, said keeper including a body portion and a tongue, said body portion being struck from said rear wall and including means for foldably joining a base of said body portion to said rear wall, said tongue being struck from said support panel and including means for foldably joining said tongue to said body portion, said locking tab having a keeper slot formed therein, said keeper slot being dimensioned for receiving said tongue.

6. A container according to claim 4, wherein said hanger-engaging means comprises an intermediate portion of said support panel provided with a hanger slot formed therethrough, said hanger slot being dimensioned for receiving a hook of a hanger, whereby a hanger hook can be inserted into said hanger slot from below and said hanger hook can rest on said intermediate portion near said hanger slot.

7. A container according to claim 6, wherein said intermediate portion of said support panel is provided further with an aperture formed therethrough, said aperture being dimensioned for receiving a tip of a hanger hook, said aperture being positioned to be spaced from said hanger slot, whereby a hanger hook can rest on a portion of said support panel between said aperture and said hanger slot.

8. A container according to claim 4, wherein a free edge of said support panel is provided with a projection, said front wall has an engaging slot formed therein, said engaging slot is dimensioned for receiving said projection, and said engaging slot extends along said top edge of said front wall.

9. A container according to claim 4, further comprising bottom closure panels including means for foldably joining said closure panels to said front and rear walls.

10. A container for a hanger-supported article, comprising:

front and rear opposed walls interconnected by a pair of opposed side walls along generally parallel fold lines to form an upright tubular enclosure;

a hanger support panel including means for foldably joining said support panel to a top edge of said rear wall, said support panel when folded being disposed at a generally right angle with respect to said front and rear walls, said support panel being dimensioned such that said support panel extends between and is supported at two spaced portions thereof by said front and rear walls, said support panel having a locking slot formed therethrough, said locking slot extending along said top edge of said rear wall, said support panel including hanger-engaging means for engagement with a hanger;

a retainer panel including means for foldably joining said retainer panel to a top edge of said front wall, said retainer panel being positioned to overlie said support panel so as to hold a hanger engaged with said hanger-engaging means;

a locking tab dimensioned for insertion into said locking slot, said locking tab including means for foldably joining said locking tab to a free edge of said retainer panel, said locking tab having a keeper slot formed therethrough, said keeper slot extending along said free edge of said retainer panel; and a keeper positioned for locking said locking tab in said locking slot, said keeper including a body portion and a tongue dimensioned for insertion into said keeper slot, said body portion being struck from said rear wall and including means for foldably joining a base of said body portion to said rear wall, said tongue being struck from said support panel and including means for foldably joining said tongue to said body portion.

11. A container according to claim 10, wherein a free edge of said support panel is provided with a projection, said front wall has an engaging slot formed therein, said engaging slot is dimensioned for receiving said projection, and said engaging slot extends along said top edge of said front wall.

12. A container according to claim 10, wherein said hanger-engaging means comprises an intermediate portion of said support panel provided with a hanger slot formed therethrough, said hanger slot being dimensioned for receiving a hook of a hanger, whereby a hanger hook can be inserted into said hanger slot from below and said hanger hook can rest on said intermediate portion near said hanger slot.

* * * * *